United States Patent [19]

Gentry et al.

[11] Patent Number: 4,951,745

[45] Date of Patent: Aug. 28, 1990

[54] STUFFING BOX AND GREASE INJECTOR FOR UNDERWATER WELLS

[75] Inventors: Ernest B. Gentry, Dallas, Tex.; Colin S. Boyle, Angus, Scotland

[73] Assignee: Otis Engineering Corporation, Dallas, Tex.

[21] Appl. No.: 324,029

[22] Filed: Mar. 14, 1989

[30] Foreign Application Priority Data

Jan. 26, 1989 [GB] United Kingdom ..... 8901660

[51] Int. Cl.[5] ..... E21B 33/076

[52] U.S. Cl. ..... 166/84; 166/86; 166/97; 166/368; 277/72 FM; 277/73; 277/127

[58] Field of Search ..... 166/82, 84, 86, 97, 166/316, 319, 329, 368; 277/4, 72 FM, 73, 64, 59, 127; 137/515, 519.5, 498

[56] References Cited

U.S. PATENT DOCUMENTS

| | | | |
|---|---|---|---|
| 3,129,009 | 4/1964 | Simpson | 166/82 |
| 3,375,013 | 3/1968 | Grantom | 277/73 |
| 3,424,247 | 1/1969 | Lee | 166/97 |
| 3,468,549 | 9/1969 | Wilson | 277/73 |
| 3,532,163 | 10/1970 | Ecuer | 166/53 |
| 3,606,347 | 9/1971 | Read et al. | 277/73 |
| 3,626,505 | 12/1971 | Douglas | 277/73 |
| 3,741,568 | 6/1973 | Rhoades | 166/82 |
| 3,762,725 | 10/1973 | Taylor | 166/84 |
| 3,815,925 | 6/1974 | Mattoon | 277/59 |
| 4,090,573 | 5/1978 | Rankin | 166/84 |
| 4,109,713 | 8/1978 | Clow | 166/84 |
| 4,266,605 | 5/1981 | LaBorde et al. | 166/97 |
| 4,423,775 | 1/1984 | Wilson | 166/84 |
| 4,476,924 | 10/1984 | Winders et al. | 166/84 |
| 4,821,799 | 4/1989 | Wong | 166/84 |

FOREIGN PATENT DOCUMENTS 1273509 5/1972 United Kingdom .

OTHER PUBLICATIONS

BlueJay Oil Tools Stuffing Box Safety Valve in Drilling–DCW, Sep. 1977 advertisement.

Otis Engineering Corp., "General Sales Catalog", OEC 5338, Mar. 1985, p. 298.

*Primary Examiner*—Bruce M. Kisliuk

*Attorney, Agent, or Firm*—Roland O. Cox

[57] ABSTRACT

An hydraulically actuated stuffing box for use on a lubricator assembly or a grease injector section to seal around flexible line run through the lubricator assembly into an underwater well. The stuffing box has a piston on which control fluid acts, compressing a resilient seal in the stuffing box to seal around the line. The piston is biased to a position not compressing the seal to prevent hydrostatic pressure of the control fluid from compressing the seal to seize the line in deep water. The stuffing box and grease injector section have a through passageway for line. Both have an internal valve, which will automatically prevent surrounding water flow into a well or well outflow into the water when no flexible line is in the passageway.

23 Claims, 2 Drawing Sheets

STUFFING BOX AND GREASE INJECTOR FOR UNDERWATER WELLS

BACKGROUND OF THE INVENTION

1. Technical Field

This invention pertains to grease injectors useful in well servicing lubricators to seal around and lubricate flexible line passing through the lubricator into and out of an underwater well, when servicing the well using wireline techniques. The invention pertains particularly to a grease injector useful in servicing underwater wells, which includes a remotely operable hydraulically actuated stuffing box for sealing around the flexible line.

2. Background Information

Stuffing boxes having a resilient seal which is compressed into sealing engagement with flexible line by hydraulic actuation are well known. Stuffing boxes of this type are used on lubricators or grease injectors as the primary seal for sealing the flexible line to the lubricator or grease injector in the lubricator.

U.S. Pat. No. 3,762,725 to Taylor discloses a wireline stuffing box with a sheave in which pressurized fluid may be conducted from a remote source and applied to opposite sides of a piston to compress the seal longitudinally to seal. U.S. Pat. No. 4,386,783 to Davis covers a stuffing box and packing nut in which the packing may be compressed manually or hydraulically to seal around rods or wireline passing through the stuffing box. In this structure, packing is compressed by conducting pressurized fluid from a remote source to act on a piston. The Davis structure includes a plug seal through which the line passes and which is moved into place by flow to prevent well outflow in case of line breakage. Both the aforementioned patents are incorporated herein for reference.

An example of a grease injector head having a stuffing box in which the packing is compressed to seal hydraulically is shown on page 298 of "General Sales Catalog" (OEC 5338), a publication of Otis Engineering Corporation, P.O. Box 819052, Dallas, TX 75381.

When servicing underwater wells, it has been found the hydraulically actuated stuffing box of Taylor, the hydraulically actuated packing nut and stuffing box of Davis and the stuffing box on the Otis Grease Head cannot be used. When these stuffing boxes are lowered into deep water, the high hydrostatic pressure of control fluid in the control line acts to compress the resilient packing much more than just into sealing engagement with the flexible line. The packing is compressed so much the line is "seized" by high frictional forces between the packing and line and the line cannot be lowered into or pulled from the well through the lubricator.

DISCLOSURE OF THE INVENTION

The stuffing box of this invention provides control of the forces compressing the resilient seal into sealing engagement around a flexible line in the stuffing box. Fluid which may be pressurized to compress the seal is delivered from surface to the stuffing box by a control line, which may be thousands of feet in length. Hydrostatic control line pressure and any pressure applied to the control line at surface together act on a piston in the stuffing box to compress the resilient seal. The piston is biased by a spring to not compress the seal.

The spring force may be varied according to water depth and control fluid gradient to prevent the hydrostatic pressure in the control line from acting on the piston and compressing the resilient seal before a lubricator having the stuffing box of this invention is lowered to underwater wellhead depth. The area of the piston may be varied to create more than sufficient downforce to compress the resilient seal into sealing engagement considering control line pressure above hydrostatic control line pressure available at the invention stuffing box.

On the lower end of the stuffing box around the through passage for line are upper and lower annular slots with a valve ball between. If the line breaks during well servicing operations and well pressure in the lubricator assembly is greater than hydrostatic water pressure around the stuffing box, outflow from the well into the lubricator will move the valve ball upward to seal on the upper seat, closing the lubricator and well to outflow and possibly preventing the well from "blowing out". If the line breaks when water pressure around the stuffing box is greater than well pressure, flow of surrouding water through the stuffing box and lubricator into the well is prevented by flow moving the valve ball downward to seal on the lower annular seat.

When well pressure is expected to be much greater than hydrostatic water pressure, a grease injector section used below the stuffing box of this invention in the lubricator assembly will lubricate the line, reduce the pressure which must be held by the resilient seal alone in the stuffing box and provide increased service life for the stuffing box seal. Grease injector heads are well known components of well servicing lubricator assemblies. An example of a grease injector control head is shown in U.S. Pat. No. 4,476,924 to Winders and Watkins. This patent is incorporated herein for reference.

All lubricator assemblies utilize a top stuffing box, with or without a line sheave, to completely or partially seal around line running into or out of the lubricator assembly and well. The grease injector of the present invention, which includes stuffing box of this invention, may be used as a lubricator assembly attachable to an underwater wellhead or used as the top component in a lubricator assembly for servicing underwater wells using line. The invention grease injector has an internal valve which automatically prevents flow of surrounding water through the grease injector into the lubricator and/or well if the well servicing line breaks. This valve also automatically prevents flow from the well out through the grease injector into surrounding water when the line breaks.

A principal object of this invention is to provide an hydraulically actuated stuffing box useful in servicing underwater wells in which the resilient packing is not compressed to seize line passing through the stuffing box by hydrostatic pressure in the control line.

Also a principal object of this invention is to provide an underwater stuffing box adaptable for use in various water depths and at various actuation pressures.

Another object of this invention is to provide an underwater stuffing box having in internal valve which automatically prevents flow in or out through the line passageway when no line is in the passageway.

Also an object of this is to provide a grease injector useful in servicing underwater wells which utilizes the stuffing box of this invention.

Another object of this invention is to provide a grease injector for servicing underwater wells having an internal valve which automatically prevents flow in or out through the line passageway.

DESCRIPTION OF THE PREFERRED EMBODIMENTS

Figure 1:
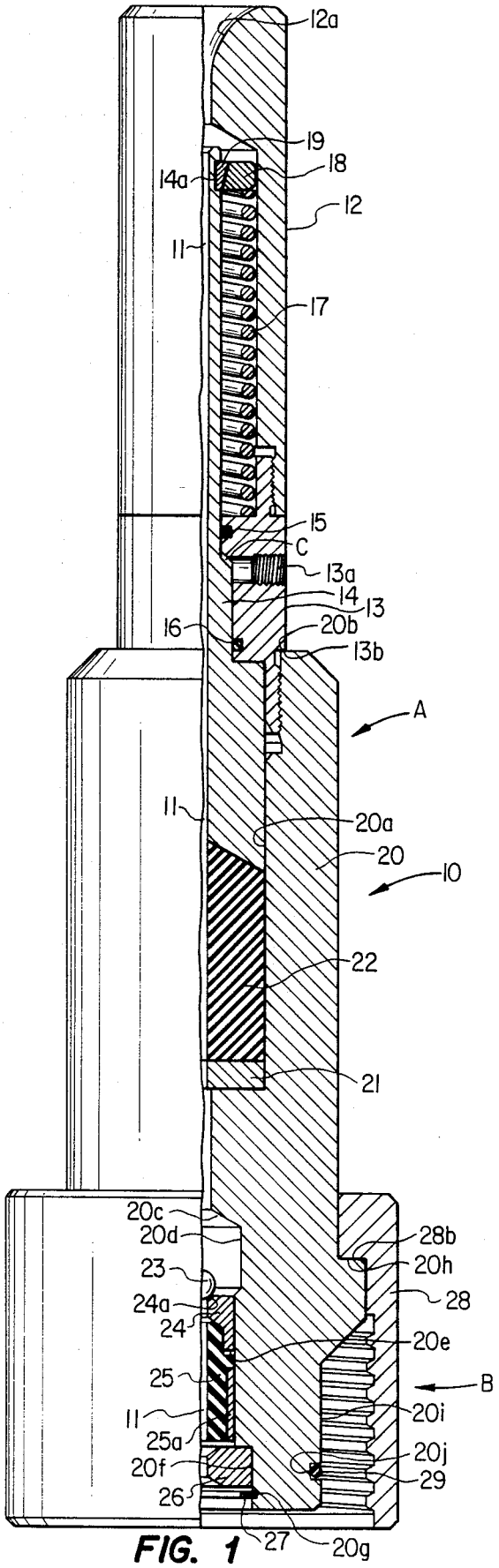
FIG. 1 is an elevation drawing in half section of the stuffing box of this invention.

FIG. 1 depicts the invention stuffing box 10 having a through passageway 11 for flexible line. Stuffing box 10 has an upper section A and a lower section B. Housed within the upper section is a resilient seal which is compressed by an hydraulically actuated annular piston into sealing engagement with flexible line in passageway 11. Lower stuffing box section B has an internal valve, which will automatically prevent flow through passageway 11 when flexible line is not in passageway 11. Section B also includes the male portion of an appropriate union connection for connecting the stuffing box to other sections in a lubricator assembly or to a wellhead for servicing an underwater well.

A spring housing 12 is connected to the upper end of piston housing 13 in upper Section A. The spring housing has a radius **12*a* for guiding flexible line into and out of passageway 11. A piston 14 is slidably sealed in housing 13 with smaller resilient seal 15 and larger resilient seal 16 to form a varriable volume pressure chamber C with the housing. The piston housing has an inlet, 13*a* which is in pressure communication with chamber C and to which a conduit for coducting pressurized fluid from a remote pressure source on the water surface to chamber C is connected. A spring 17 is compressed between a shoulder in the piston housing and a ring 18 biasing the piston upwardly. Ring 18 is biased upwardly by spring 17, camming tapered split ring 19 into piston groove 14*a* and positioning ring 18 adjacent groove 14*a***.

Figure 3:
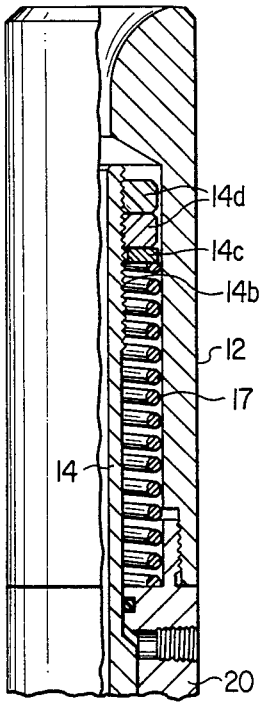
FIG. 3 is a fragmentary drawing of FIG. 1 showing alternate structure for varying spring force.

FIG. 3 shows alternate structure for compressing spring 17 and varying the upward bias on piston 14. The piston has threads **14*b*, a washer 14*c* and nuts 14*d***. The nuts may be turned on the piston to increase or decrease spring compression and upward bias on the piston.

Piston housing 13 in FIG. 1 is connected to the upper end of body 20, which has a bore **20*a*. Piston housing 13 has a sealing surface 13*b* which engages sealing surface 20*b* on the body, sealing the housing to the body. Installed in bore 20*a* below the lower end of the piston on a shoulder in the body is a bushing 21. A resilient line seal 22 is installed in bore 20*a*** between the lower end of the piston and the bushing.

In lower stuffing box section B body 20 has an annular sealing surface **20*c*, and bores 20*d*, 20*e* and 20*f*, which has a groove 20*g***.

A valve ball 23 is captured in body bore **20*d* by slidable guide 24 in body bore 20*e*. This guide has an upper annular sealing surface 24*a*. Ball 23 is sealingly engageable with sealing surfaces 20*c* or 24*a*. Also slidable in bore 20*e* is a plunger 25, which is molded of resilient material, such as rubber or the like and the molded material is bonded to a sleeve 25*a* around the lower end. A lower guide 26 is positioned in body bore 20*f* by a retaining ring 27 in groove 20*g***.

The male union portion on body 20 in section B includes a collar 28 having threads **28*a* and a shoulder 28*b*, which engages body shoulder 20*h*. The male union portion also includes reduced diameter 20*i*, groove 20*j* and resilient seal 29**.

Spring 17 in stuffing box 10 of FIG. 1 should be designed to exert an upward force on ring 18 and piston 14 which when multiplied by the annular are sealed by resilient seals 15 and 16 equals the hydrostatic pressure of control fluid in the control line acting in chamber C when the stuffing box and lubricator are connected to an underwater wellhead.

If the alternate stuffing box structure of FIG. 3 is used, spring compression should be adjusted for desired upward bias on piston 14 before the stuffing box is lowered to the underwater wellhead.

Stuffing box 10 is used by connecting on top of an underwater lubricator assembly. A flexible line is passed through the lubricator assembly and stuffing box moving ball 23 aside out of passageway 11 into the annular area between the line and body bore **20*c*. Well servicing tools are conducted to the flexible line and a control line is connected to the stuffing box inlet 13*a*. The other end of the control line is connected to a remote source of pressurized fluid on the surface. The lubricator and control line filled with control fluid are then lowered through water down and connected to the wellhead of the well to be serviced. When the stuffing box reaches wellhead water depth, hydrostatic pressure of fluid in the control line does not move piston 14 downwardly to compress seal 22 because the upward force of spring 17** times the annular sealed piston area equals the hydrostatic pressure of control fluid in the control line.

When the well is opened admitting well pressure into the lubricator, the stuffing box is actuated to seal around line and isolate surrounding water pressure from well pressure.

At any time during well servicing operations, seal 22 may be compressed into sealing engagement with line in passageway 11 by pressurizing fluid in the control line at the surface to act downwardly on the annular piston area sufficiently to overcome the upward forces of spring 17 on piston 14 and move piston 14 downwardly. Reduction of pressure in the control line permits spring 17 to move the piston upwardly, reducing compression in seal 22.

If line in passageway 11 breaks or for other reason moves out of this passageway during well servicing operations, well flow out impinging on ball 23 will lift the ball to sealingly engage sealing surface **20*c* and close the stuffing box and well flow into surrounding water. Higher well pressure in the lubricator acting on the lower end area of plunger 25 may move the plunger and guide 24 upwardly in body bore 20*d* and into body bore 20*c***.

Figure 2A:
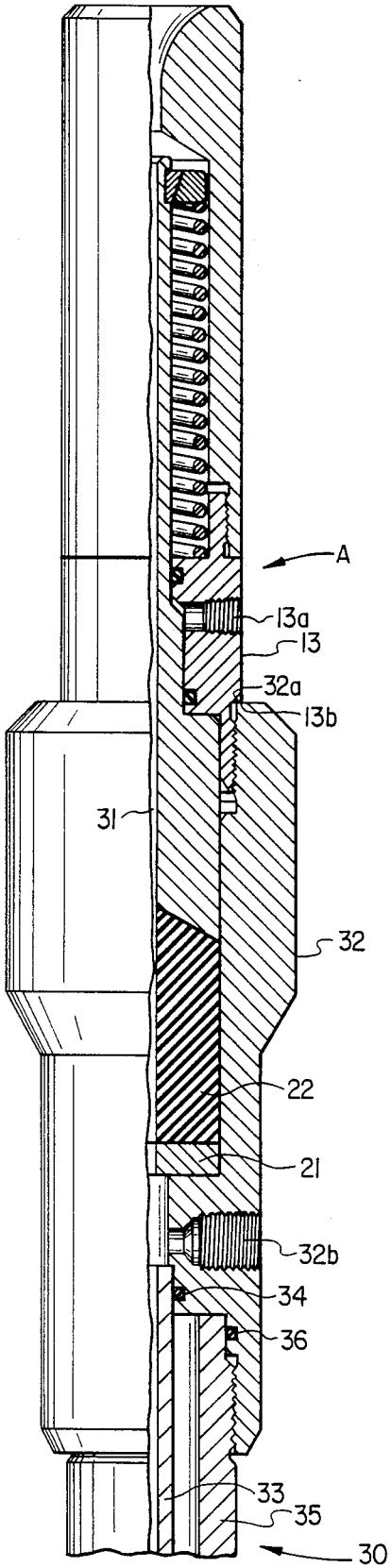
FIGS. 2A, 2B and 2C together is a half sectioned drawing in elevation of the grease injector of this invention which includes the stuffing box of FIG. 1.
Figure 2B:
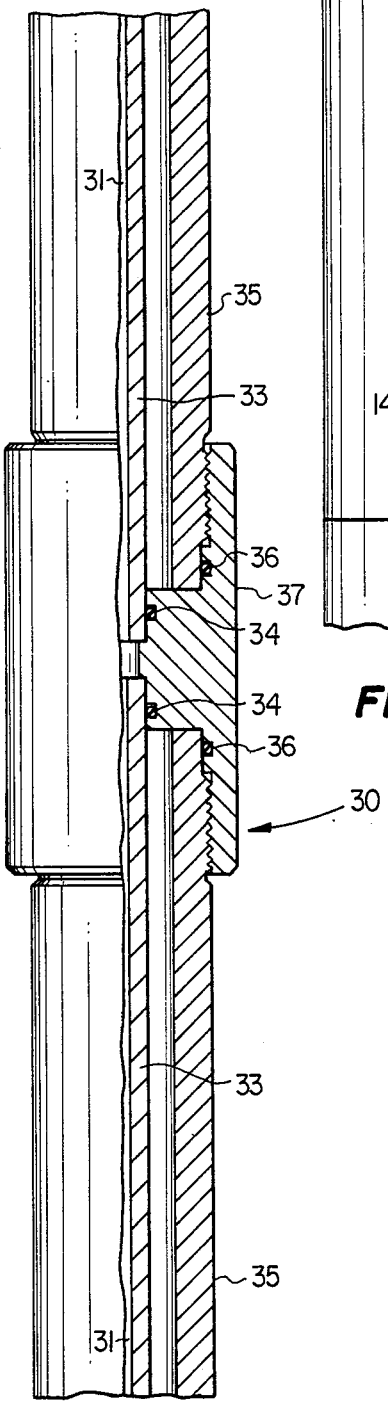
Figure 2C:
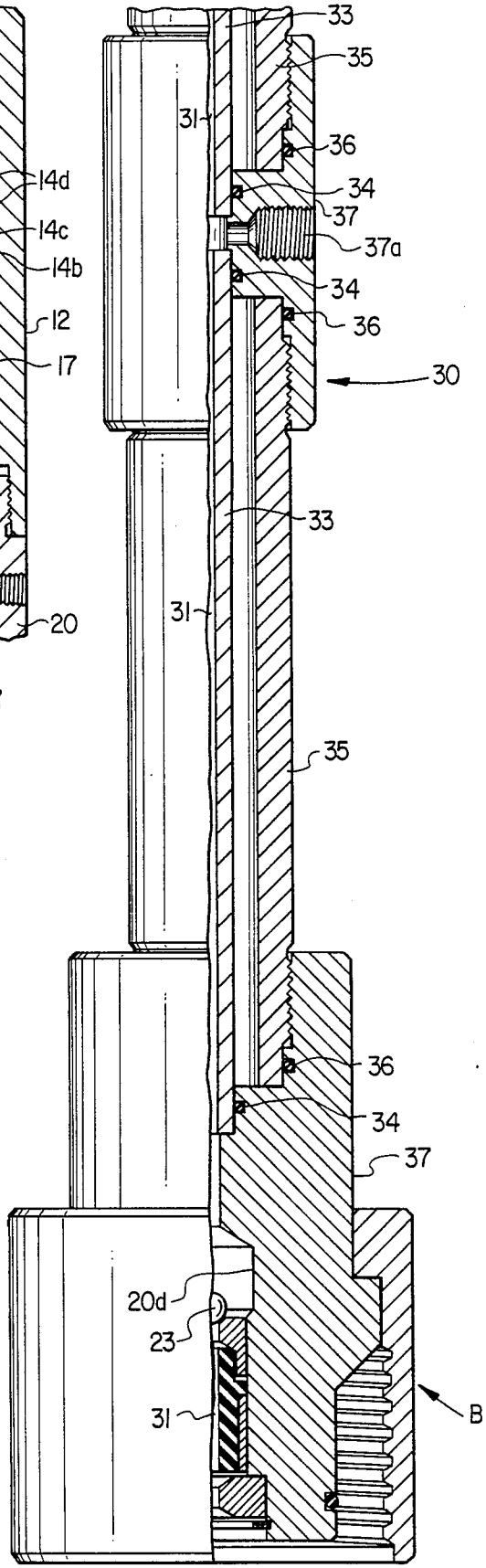

FIGS. 2A, 2B and 2C show a grease injector section 30 for use in an underwater lubricator assembly. The injector has a through passageway 31 for flexible line. This injector section utilizes the structure of upper section A of stuffing box 10 for sealing the injector section to flexible line in passageway 31. Sealing surface **13*b* in housing 13 sealingly engages a sealing surface 32*a* on body 32, sealing housing 13 to body 32 which houses bushing 21 and resilient seal 22**.

Body 32 has an outlet **32*b* which is in pressure communication with the inside of a first inner tube 33 and passageway 31. The inside diameter of tube 33 is 0.003 inches to 0.005 inches larger than the outside diameter of the line to be run through tube 33 in passageway 31. First tube 33 is sealed in body 32 with a first resilient seal 34. A first outer tube 35 is connected to the lower end of body 32 and sealed to the body with first resilient seal 36. The lower end of first inner tube 33 is sealed in a first outer tube connector 37 with a second resilient seal 34. The lower end of first outer tube 35 is connected to connector 37 and sealed to the connector with a second resilient seal 36**.

A second inner tube 33, extends downwardly from and is sealed to the first connector with a third resilient seal 34 and a second outer tube 35 is connected to the connector and sealed with a third seal 36.

The lower end of second inner tube 33 is sealed in a second connector 37 with fourth resilient seal 34. The lower end of second outer tube 35 is connected to the second connector and sealed to the connector with fourth resilient seal 36.

The second connector has an inlet 37*a*. Below this inlet, the upper end of a third inner tube 33 is sealed in the second connector with a fifth resilient seal 34 and a third outer tube 35 is connected to the connector and sealed with a fifth resilient seal 36.

The lower end of third inner tube 33 is sealed in a lower body 37 with a sixth seal 34 and the lower end of third outer tube 35 is connected to body 37 and sealed to the body with a sixth resilient seal 36. The lower end of body 37 is identical to lower section B of stuffing box 10 shown in FIG. 1 and includes the same internal valve and male connection for connecting the injector section to other sections in an underwater lubricator assembly or to an underwater wellhead.

FIGS. 2A, 2B and 2C show the grease injector section of this invention having three inner tubes 33. If pressure in the underwater well is anticipated to be much greater than hydrostatic water pressure around the wellhead, more inner tubes, along with outer tubes and connectors may be required for the grease injector to seal in a higher well pressure alone without the aid of the stuffing box.

The grease injector section 30 of FIGS. 2A, 2B and 2C may be used by connecting on top of an underwater lubricator assembly. A flexible line is passed through passageway 31 in section 30 moving ball 23 asid into bore 20*d*. Well servicing tools are connected to the flexible line for lowering into the well. A control line is connected to inlet 13*a* to supply control fluid to the stuffing box on section 30 from a remote pressure source on the surface. A control line is connected in inlet 37*a* which is connected with a source of pressurized grease on the surface. A control line is also connected in outlet 32*b* for conducting grease from section 30 back to the pressurized grease source.

The grease injector section with control and grease lines attached is lowered through water and connected to the wellhead to be serviced. Again, the hydrostatic head of fluid in the control line does not operate the stuffing box to seize flexible line in passageway 31.

When the well is opened admitting pressure into the lubricator and grease injector section, the stuffing box may be operated in conjunction with the grease injector as required to seal around line in passageway 31 and isolate surrounding water pressure from well pressure. As previously described, the stuffing box is actuated to sealingly engage the line by increasing fluid pressure in the control line. The grease injector section is operated to seal around the line by pumping grease into section 30 through inlet 37*a*, which is injected into the very small clearance between the outside of line in passageway 31 and the inside of tubes 33 making up most of the passageway. As the length of this grease "barrier" in the tubes increases, more pressure is required to force the barrier out of the very small clearance. The grease also provides lubrication for line moving through passageway 31 in the grease section. Any excess injected grease moves upwardly through tubes 33 and passageway 31 to outlet 32*b* and returns to the grease source via the grease line connected in the outlet.

If the flexible line is removed from passageway 31 while the lubricator assembly with grease injector section is connected to an underwater wellhead, valve ball 23 will prevent well outflow into the surrounding water or water inflow into the well as previously described for stuffing box 10.

We claim:

1. An hydraulically actuated underwater stuffing box having a through passageway for flexible line comprising:

(a) a body;

(b) a resilient seal in said body around the passageway;

(c) pressure responsive means in said body for compressing said resilient seal into sealing engagement with flexible line in said passageway;

(d) biasing means for biasing said pressure responsive means toward a position not compressing said resilient seal; and (e) valve means in said body below said resilient seal for preventing upward and downward flow through said passageway when no flexible line is in said passageway, said valve means including: an annular upper sealing surface in said body around said passageway below said resilient seal, a guide having an annular lower sealing surface slidably mounted around said passageway in said body below said body sealing surface, and a valve ball sealingly engageable with said body sealing surface and said guide sealing surface.

2. The underwater stuffing box of claim 1 wherein the pressure responsive means comprise:

(a) a piston around the through passageway having an annular pressure responsive area thereon, said piston slidably mounted and sealed in the body to form a variable volume pressure chamber with said body; and (b) an inlet into said variable volume pressure chamber for admitting pressurized fluid to act on said pressure responsive piston area.

3. The underwater stuffing box of claim 2 wherein the biasing means comprise:

(a) a shoulder in the body;

(b) a ring around the piston;

(c) a spring around said piston between said shoulder and said ring; and (d) means for positioning said ring on said piston to compress said spring.

4. The underwater stuffing box of claim 3 wherein the means for positioning the ring on the piston comprise:

(a) a groove around the piston;

(b) a split ring having a downwardly and inwardly tapering outer surface, said split ring retained in said groove by engagement with a downwardly and inwardly tapering surface on the inside of the ring around the piston.

5. The stuffing box of claim 2 further including means for adjusting the biasing means.

6. The stuffing box of claim 5 wherein the means for adjusting the biasing means comprise:
(a) a shoulder in the body;
(b) threads on the piston;
(c) a washer around the piston;
(d) a spring around the piston between said washer and said shoulder; and
(e) nuts on said piston threads for positioning said washer and one end of said spring and jamming said washer in position.

7. An underwater grease injector section having a through passageway for flexible line comprising:
(a) hydraulically actuated stuffing box means for sealingly engaging flexible line in the through passageway, said stuffing box means including,
a body,
a resilient seal in said body around said passageway,
pressure responsive means for compressing said seal into sealing engagement with flexible line in said passageway,
biasing means for biasing said pressure responsive means toward a position not compressing said seal,
(b) grease injector means for injecting grease into said through passageway to seal around and lubricate flexible line in said passageway; and
(c) a lower body having valve means therein for preventing upward and downward flow through said passageway when flexible line is not in said passageway.

8. The grease injector section of claim 7 wherein the pressure responsive means comprise:
(a) a piston around the through passageway having an annular pressure responsive area thereon, said piston slidably mounted and sealed in the body to form a variable volume pressure chamber with said body; and
(b) an inlet into said variable volume pressure chamber for admitting pressurized fluid to act on said pressure responsive piston area.

9. The grease injector section of claim 8 wherein the biasing means comprise:
(a) a shoulder in the body;
(b) a ring around the piston;
(c) a spring around said piston between said shoulder and said ring; and
(d) means for positioning said ring on said piston to compress said spring.

10. The grease injector section of claim 9 wherein the means for positioning the ring on the the piston comprise:
(a) a groove around the piston;
(b) a split ring having a downwardly and inwardly tapering outer surface, said split ring retained in said groove by engagement with a downwardly and inwardly tapering surface on the inside of the ring around the piston.

11. The grease injector section of claim 8 further including means for adjusting the biasing means.

12. The grease injector section of claim 11 wherein the means for adjusting the biasing means comprises:
(a) a shoulder in the body;
(b) threads on the piston;
(c) a washer around the piston;
(d) a spring around the piston between said washer and said shoulder; and
(e) nuts on said piston threads for positioning said washer and one end of said spring and jamming said washer in position.

13. The grease injector section of claim 7 wherein the grease injector means comprise:
(a) an inner tube around the through passageway, said inner tube sealed in the stuffing box body and lower body;
(b) an inlet for grease in communication with said passageway, said inlet above the lower body valve means; and
(c) an outlet for grease in communication with said passageway, said outlet in said stuffing box body below the resilient seal.

14. The grease injector section of claim 13 further including an outer tube around the inner tube, said outer tube connected and sealed to the stuffing box body and lower body.

15. The grease injector section of claim 7 wherein the grease injector means comprise:
(a) an outlet for grease in communication with the passageway, said outlet in the stuffing box body below the resilient seal;
(b) upper and lower inner tubes around the passageway, the upper end of said upper inner tube sealed in the stuffing box body and the lower end of said lower inner tube sealed in the lower body;
(c) upper and lower outer tubes around said upper and lower inner tubes; and
(d) a connector having an inlet for grease in communication with said passageway, the lower end of said upper inner tube and the upper end of said lower inner tube sealed in said connector and said the lower end of said upper outer tube and the upper end of said lower outer tube connected and sealed to said connector.

16. The grease injector section of claim 7 wherein the grease injector means comprise:
(a) an outlet for grease in communication with the passageway, said outlet in the stuffing box body below the resilient seal;
(b) inner tubes around the passageway, the upper end of the upper inner tube sealed in the stuffing box body and the lower end of the lower inner tube sealed in the lower body;
(c) an outer tube around each inner tube, the upper end of the upper outer tube connected and sealed to said stuffing box body and the lower end of the lower outer tube connected and sealed to the lower body;
(d) a connector having an inlet for grease in communication with said passageway, the upper end of said lower inner tube sealed in said connector and the upper end of said lower outer tube sealed and connected to said connector; and
(e) connectors for connecting and sealing said outer tubes together and sealing said inner tubes to.

17. The underwater grease injection section of claim 7 wherein the valve means in the lower body comprise:
(a) an annular upper sealing surface in said lower body around the passageway;
(b) a guide having an annular sealing surface slidably mounted around said passageway in said body below said annular upper sealing surface; and
(c) a valve ball sealingly engageable with said annular upper sealing surface and said guide annular sealing surface.

18. An underwater grease injector section having a through passageway for flexible line comprising:

(a) an hydraulically actuated underwater stuffing box including,
  a body having an outlet in communication with the passageway;
  a resilient seal in said body around said passageway,
  pressure responsive means for compressing said resilient seal into sealing engagement with flexible line in the through passageway,
  biasing means for biasing said pressure responsive means toward a position not compressing said resilient seal;
(b) a first inner tube around said passageway sealed in said body;
(c) a first outer tube around said inner tube, said outer tube connected and sealed to said body;
(d) a first connector connected to said first outer tube and sealed to said first inner and outer tubes;
(e) a second inner tube around said passageway, said inner tube sealed in said first connector;
(f) a second outer tube around said second inner tube, said second outer tube connected and sealed to said first connector;
(g) a second connector having an inlet communicating with said passageway, said second outer tube connected to said second connector and said second inner and outer tubes sealed to said connector;
(h) a third inner tube around said passageway, said inner tube sealed in said second connector below said inlet;
(i) a third outer tube around said third inner tube, said third outer tube connected and sealed to said second connector below said inlet; and
(j) a lower body having an appropriate connection thereon,
  an annular upper sealing surface in said lower body around said passageway,
  a guide having an annular sealing surface slidably mounted around said passageway in said lower body below said annular upper sealing surface, and
  a valve ball sealingly engageable with said annular upper sealing surface and said guide annular sealing surface.

19. The grease injector section of claim 18 wherein the pressure responsive means comprise:

(a) a piston around the through passageway having an annular pressure responsive area thereon, said piston slidably mounted and sealed in the body to form a variable volume pressure chamber with said body; and
(b) an inlet into said variable volume pressure chamber for admitting pressurized fluid to act on said pressure responsive piston area.

20. The grease injector section of claim 19 wherein the biasing means comprise:

(a) a shoulder in the body;
(b) a ring around the piston;
(c) a spring around said piston between said shoulder and said ring; and
(d) means for positioning said ring on said piston to compress said spring.

21. The grease injector section of claim 20 wherein the means for positioning the ring on the piston comprise:

(a) a groove around the piston;
(b) a split ring having a downwardly and inwardly tapering outer surface, said split ring retained in said groove by engagement with a downwardly and inwardly tapering surface on the inside of the ring around the piston.

22. The grease injector section of claim 19 further including means for adjusting the biasing means.

23. The grease injector section of claim 22 wherein the means for adjusting the biasing means comprise:

(a) a shoulder in the body;
(b) threads on the piston;
(c) a washer around the piston;
(d) a spring around the piston between said washer and said shoulder; and
(e) nuts on said piston threads for positioning said washer and one end of said spring and jamming said washer in position.

* * * * *